US007241104B2

(12) United States Patent
Wilson et al.

(10) Patent No.: US 7,241,104 B2
(45) Date of Patent: Jul. 10, 2007

(54) TWO PHASE FLOW CONDITIONER FOR PUMPING GASSY WELL FLUID

(75) Inventors: Brown Lyle Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 324 days.

(21) Appl. No.: 10/784,340

(22) Filed: Feb. 23, 2004

(65) Prior Publication Data

US 2005/0186065 A1 Aug. 25, 2005

(51) Int. Cl.
*F04D 29/30* (2006.01)

(52) U.S. Cl. ..... 415/1; 415/211.2; 415/199.2; 416/223 R

(58) Field of Classification Search ..... 415/1, 415/143, 192, 193, 199.1, 199.2, 199.3, 199.4, 415/199.5, 199.6, 209.1, 210.1, 211.2, 901; 417/423.3, 423.5, 424.1, 424.2; 166/105–106; 416/223 R, 238, 243, 197 R
See application file for complete search history.

(56) References Cited

U.S. PATENT DOCUMENTS

| | | | | |
|---|---|---|---|---|
| 2,576,700 | A | 11/1951 | Schneider | |
| 3,267,869 | A * | 8/1966 | Vartapetov et al. | 415/190 |
| 3,438,329 | A * | 4/1969 | Fuller | 415/199.3 |
| 4,080,096 | A | 3/1978 | Dawson | |
| 4,778,341 | A | 10/1988 | Corradini et al. | |
| 5,224,821 | A | 7/1993 | Ozawa | |
| 5,628,616 | A | 5/1997 | Lee | |
| 5,885,058 | A | 3/1999 | Vilagines et al. | |
| 6,241,470 | B1 | 6/2001 | Oakley et al. | |
| 6,312,216 | B1 | 11/2001 | Falcimaigne | |
| 6,412,562 | B1 | 7/2002 | Shaw | |
| 2003/0170112 | A1 | 9/2003 | Kao | |
| 2004/0047728 | A1 * | 3/2004 | Kao | 415/199.1 |

FOREIGN PATENT DOCUMENTS

| | | | | |
|---|---|---|---|---|
| EP | 0671563 | A1 | 9/1995 | |
| JP | 62-96799 | A * | 5/1987 | 415/143 |

* cited by examiner

*Primary Examiner*—Ninh H. Nguyen
(74) *Attorney, Agent, or Firm*—Bracewell & Giuliani LLP

(57) ABSTRACT

A centrifugal pump pumps well fluid with a high gaseous content by conditioning the well fluid with a conditioning impeller and conditioning diffuser design for use with gaseous well fluid. The conditioning impellers have vanes that are curved with a leading edge that is rotationally forward and axially below, or upstream, of a trailing edge. The outer end of the leading edge is rotationally forward of the inner end of the leading edge, which forces the well fluid radially inward and mixes the gas and liquids in the well fluid. The conditioning diffusers have blades that are curved with a leading edge that is rotationarily rearward and axially below a trailing edge. The blades are portions of a sphere, with a concaved side receiving well fluid from the conditioning impellers. The spherical shape forces the well fluid radially inward and axially upward.

22 Claims, 4 Drawing Sheets

Fig. 3
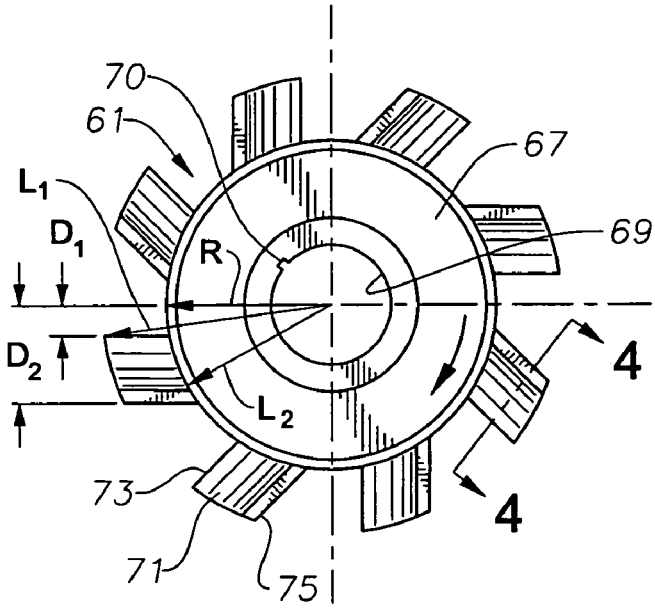
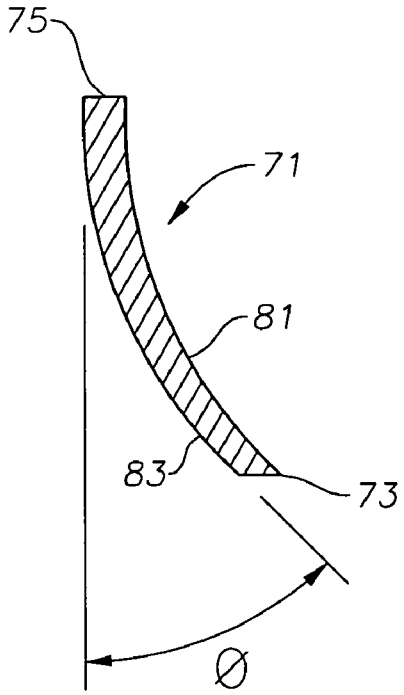
Fig. 4
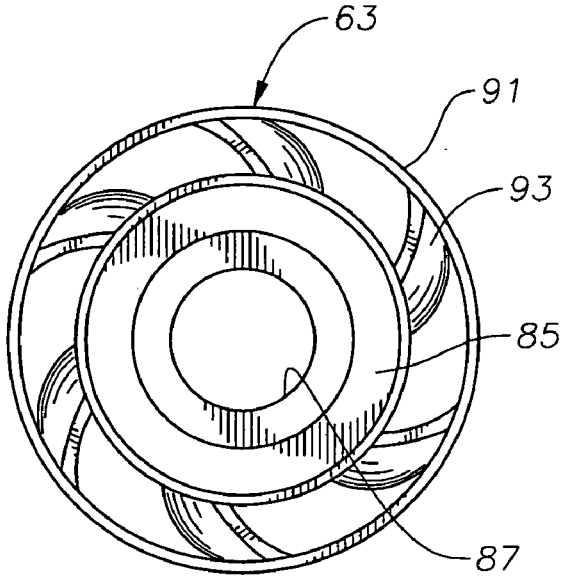
Fig. 5

TWO PHASE FLOW CONDITIONER FOR PUMPING GASSY WELL FLUID

BACKGROUND OF THE INVENTION

1. Field of the Invention

This invention relates in general to conditioning well fluid that is pumped to the surface from a subsea well. More specifically, this invention relates to an impeller configuration designed for fluids with a high gas content entrained within the fluids.

2. Background of the Invention

Centrifugal pumps have been used for pumping well fluids for many years. Centrifugal pumps are designed to handle fluids that are essentially all liquid. Free gas frequently gets entrained within well fluids that are required to be pumped. The free gas within the well fluids can cause trouble in centrifugal pumps. As long as the gas remains entrained within the fluid solution, then the pump behaves normally as if pumping a fluid that has a low density. However, the gas frequently separates from the liquids.

The performance of a centrifugal pump is considerably affected by the gas due to the separation of the liquid and gas phases within the fluid stream. Such problems include a reduction in the pump head, capacity, and efficiency of the pump as a result of the increased gas content within the well fluid. The pump starts producing lower than normal head as the gas-to-liquid ratio increases beyond a certain critical value, which is typically about 10-15% by volume. When the gas content gets too high, the gas blocks all fluid flow within the pump, which causes the pump to become "gas locked." Separation of the liquid and gas in the pump stage causes slipping between the liquid and gas phases, which causes the pump to experience lower than normal head. Submersible pumps are generally selected by assuming that there is no slippage between the two phases or by correcting stage performance based upon actual field test data and past experience.

Many of the problems associated with two phase flow in centrifugal pumps would be eliminated if the wells could be produced with a submergence pressure above the bubble point pressure to keep any entrained gas in the solution at the pump. However, this is typically not possible. To help alleviate the problem, gases are usually separated from the other fluids prior to the pump intake to achieve maximum system efficiency, typically by installing a gas separator upstream of the pump. Problems still exist with using a separator upstream of a pump since it is necessary to determine the effect of the gas on the fluid volume in order to select the proper pump and separator. Many times, gas separators are not capable of removing enough gas to overcome the inherent limitations in centrifugal pumps.

A typical centrifugal pump impeller designed for gas containing liquids consists of a set of one-piece rotating vanes, situated between two disk type shrouds with a balance hole that extends into each of the flow passage channels formed by the shrouds and two vanes adjacent to each other. The size of the balance holes vary between pump designs. Deviations from the typical pump configurations have been attempted in an effort to minimize the detrimental effects of gaseous fluids on centrifugal pumps. However, even using these design changes in the impellers of the centrifugal pumps is not enough. There are still problems with pump efficiency, capacity, head, and gas lock in wells producing well fluids with a high gas content.

SUMMARY OF THE INVENTION

Centrifugal pumps impart energy to a fluid being pumped by accelerating the fluid through an impeller. This invention provides a novel method and apparatus for conditioning well fluid with a high gaseous content for pumping to the surface from the subsea well.

A well pump assembly is designed for pumping a mixed flow of liquid and gas. The well pump assembly includes a conditioning impeller. The conditioning impeller has a hub with a bore for engaging a shaft for rotation therewith in a forward rotation direction. The pump assembly also has a stationary conditioning diffuser. The conditioning diffuser is juxtaposed with the conditioning impeller to receive fluid from the impeller. The conditioning diffuser has a plurality of blades that incline from a downstream side to an upstream side of the diffuser in a rearward rotational direction. Each conditioning impeller has a plurality of impeller vanes extending from the outer circumference of the hub of the conditioning impeller. Each of the vanes incline in the forward rotational direction from a downstream side of the impeller, defining a leading edge and a trailing edge. A radial line passing through an outer end of the leading edge of each of the vanes is rotationally forward of an inner end of the leading edge of each of the vanes for forcing liquid and gas radially inward and into the diffuser.

The improvements provide homogenization to the two-phase flow due to the split-vane design. A gas conditioning section is mounted upstream, or axially below an electric submersible pump in conduit containing well fluid. The gas conditioning section is within a tubular housing and includes a series of impellers and diffusers. A shaft rotates the impellers. Each stage of impeller and diffuser results in an increase in well fluid pressure and turbulence in the well fluid to proved homogenization between the gases and liquids in the well fluid. The gas conditioning section is in fluid communication with an intake of a pumping section having conventional impellers for transmitting the well fluid to the surface. The conditioning shaft is mechanically coupled to the pump shaft by a mechanical coupling.

BRIEF DESCRIPTION OF THE DRAWINGS

FIG. 3 is a top plan view of an impeller of the centrifugal pump of FIG. 1.

FIG. 4 is a sectional view of an impeller blade of the impeller shown in FIG. 3.

FIG. 5 is a top plan view of a diffuser of the centrifugal pump of FIG. 1.

DETAILED DESCRIPTION OF THE PREFERRED EMBODIMENT

Figure 1:
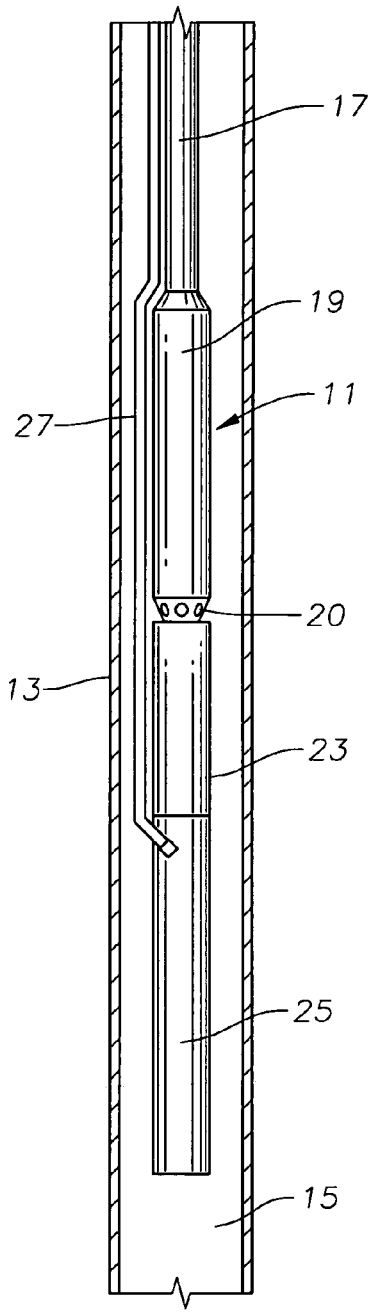
FIG. 1 is a side elevation view of a centrifugal pump assembly constructed in accordance with this invention and is disposed in a viscous fluid within a well conduit.

Referring to FIG. 1, an electrical submersible pump assembly 11 is shown installed within a string of conduit 13. Conduit 13 can be a riser extending from a subsea wellhead to a platform at the surface, or coiled tubing extending into a subsea well. Conduit 13 contains a well fluid 15 which flows upward from a production region (not shown). In the application of this invention, well fluid 15 will typically be a heavy viscous crude and gas mixture.

Pump assembly 11 includes a centrifugal pump 19 which is suspended in conduit 13 by a string of production tubing 17. A plurality of pump inlets 20 are located toward an axially lower portion of pump 19 for receiving well fluid 15. Pump 19 is mounted at its lower end to a conventional seal section 23. An electrical motor 25 is supported on the lower end of seal section 23. Seal section 23 seals well fluid 15 from lubricant within electrical motor 25 and also reduces the pressure differential between the hydrostatic pressure in the well and the internal pressure of the lubricant in the motor. Additionally, seal section 23 has thrust bearings for absorbing axial thrust generated by pump 19. Electrical motor 25 is a large AC motor which is supplied with electrical power through a power cable 27 extending down from the floating production platform or vessel (not shown).

Figure 2:
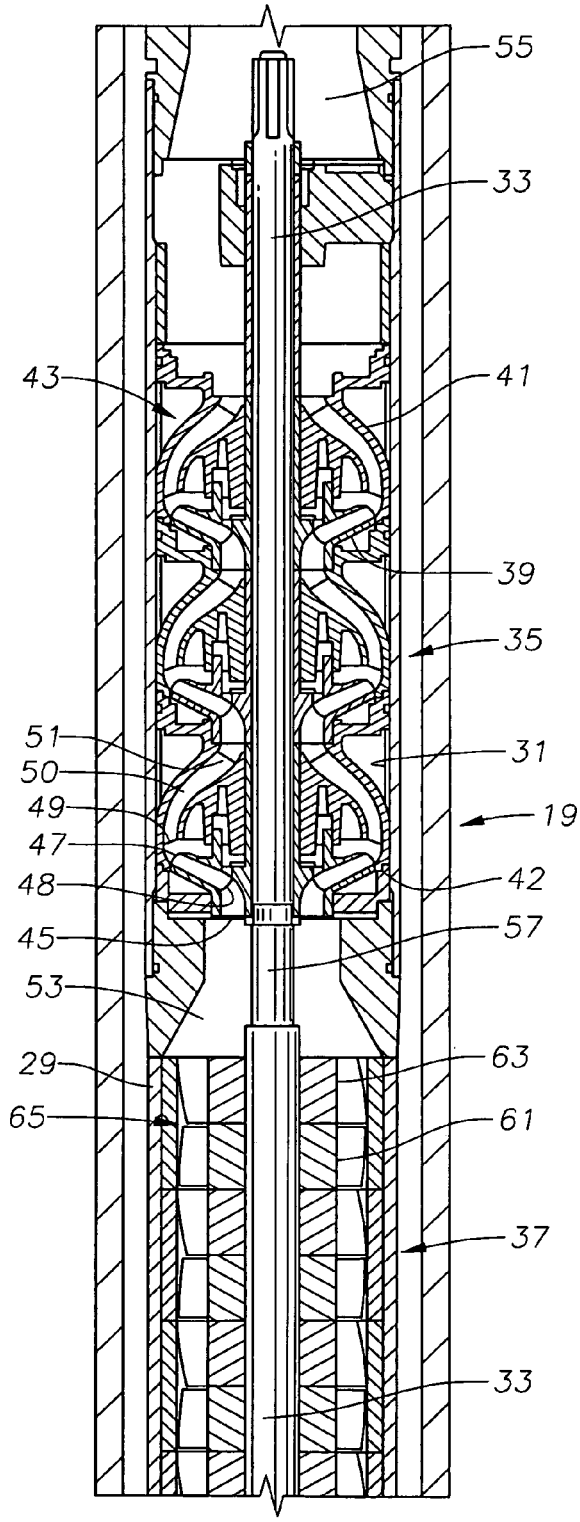
FIG. 2 is a sectional view of a portion of the centrifugal pump of the pump assembly shown in FIG. 1.

In FIG. 2, an enlarged partial view of electrical submersible pump 19 is shown installed within conduit 13. Pump 19 has a cylindrical pump housing 29. Housing 29 has an axial inner passage 31. A shaft 33 is be driven by the motor 25 (FIG. 1) mounted below pump 19 and separated by the seal section 23 (FIG. 1). Housing 29 comprises an outer casing of the pump, and the outer casing has an axial centerline. Shaft 33 extends through a portion of the outer casing along the axial centerline of the outer casing. Inlet 20 locates in the bottom of the housing 29 for drawing well fluid 15 into passage 31. In the embodiment of pump 19 shown in FIGS. 1 and 2, pump 19 comprises an upper section 35 and a lower section 37. Upper section 35 produces most of the pumping forces and generates a large portion of head for conveying well fluid 15 up conduit 15. Lower section 37 mixes or conditions well fluid 15 before entering upper section 35. Lower section conditions well fluid 15 by creating turbulence and mixing the gaseous and liquid fluids so that gas separation is less likely to occur in upper section 35. A typical pumping section of a pump 19 can handle a well fluid 15 with a gas content of up to about 25%. Lower section 37 conditions well fluid 15 so that upper section 35 can pump well fluids with up to about 40% gas content.

Upper section 35 comprises a plurality of upper impellers 39 and upper diffusers 41 located within housing 29. Upper impellers and diffusers 39, 41 are alternatingly stacked over shaft 33, with well fluids 15 entering upper section 35 through the axially lowermost impeller 39 and exiting upper section 35 through the axially uppermost diffuser 41. Each pair of upper impellers and diffusers 39, 41 define a pump stage 43. Each stage 43 works on well fluid 15 to lift well fluid a predetermined height, or head, in conduit 13. The amount of head, or distance well fluid 15 travels up conduit 13, is increased by increasing the diameter of impellers 39 or by including additional stages 43 in pump 19. Due to size constraints within pump housing 29 and conduit 13, increasing impeller diameter is not feasible. Therefore, there are typically a plurality of pump stages 43. The plurality of pump stages 43 combine to generate enough head or lift on well fluid 15 to reach a vessel or platform at the surface. The number of pump stages 43 is determined by the pumping requirements desired for conveying well fluid 15 to the platform.

Upper impellers 39, in a manner known in the art, slide over and attach to shaft 33 so that impellers 39 rotate with shaft 33. Each impeller 39 has an inner portion that extends axially upward around shaft 33 and engages the impeller 39 in the next pump stage 43. Therefore, each impeller 39 engages and stacks on the impeller 39 of the immediately preceding pump stage 43. Upper diffusers 41 slide over shaft 33 and around of upper impellers 39 along shaft 33. In a manner known in the art, an outer portion of the axially lowermost diffuser 41 engages protruding surface 42 that is fixedly connected to housing 29. An outer portion of additional diffusers 41 of each pump stage 43 above the lowermost diffuser 41 stack on the lowermost diffuser 41 engaging surface 42. Upper diffusers 41 do not connect to shaft 33 or impellers 39, which allows upper diffusers 41 to remain stationary within housing 29 relative to upper impellers 39 and rotating shaft 33.

An impeller inlet 45 is located at a radially inward portion of the lower side of each upper impeller 39 for receiving well fluid 15. An impeller outlet 47 is located at a radial outward portion of the upper side of each impeller 39. Vanes 48 extend between impeller inlet 45 and outlet 47. The path between impeller inlet and outlet 45, 47 is curved. Vanes 48 act upon well fluid 15 passing through each upper impeller 39 to increase the fluid velocity as impeller 39 rotates. A diffuser inlet 49 located at a radially outward and lower portion of each upper diffuser 41 receives well fluids 15 with an increased velocity from outlets 47 of each upper impeller 39. A curved channel 50 within each diffuser 41 extends radially inward and upward to a diffuser outlet 51. Channel 50 conveys well fluid 15 from impeller outlet 47 to the impeller inlet 45 of the following pump stage 43. A volute passage 53 carries well fluid 15 entering upper section 35 flows to impeller inlet 45 of the lowermost impeller 39 from lower section 37. An exit volute 55, located above the uppermost pump stage 43, receives well fluid 15 from the diffuser outlet 51 of the upper most upper diffuser 41. Exit volute 55 carries well fluid from pump 19 to conduit 13 for conveyance to the vessel or platform at the surface.

In the embodiment of pump 19 shown in FIGS. 1 and 2, shaft 33 extends axially through both upper and lower sections 35, 37 of pump 19. A coupling 57 connects the portion of shaft 33 extending through upper section 35 with the portion of shaft 33 extending through lower section 37. Lower section 37 comprises a plurality of lower conditioning impellers 61 and lower conditioning diffusers 63 alternatingly stacked within housing 29. Each pair of lower impellers and diffusers 61, 63 define conditioning stages 65. In the preferred embodiment, one lower impeller 61 is located axially below one of lower diffuser 63 in each stage 65. Accordingly, well fluid 15 entering pump 19 through pump inlet 20 engages one of lower impellers 61 before one of lower diffusers 63. Additionally, well fluid 15 exiting lower section 37 engages one of lower diffusers 63 before entering volute passage 53 on the way to upper section 35.

Referring to FIG. 3, lower impeller 61 is shown from the side of impeller 61 that is immediately below a corresponding lower diffuser 63 in a stage 65. This side is the downstream side of impeller 61 and well fluid 15 exits each lower impeller 61 from the side shown illustrated in FIG. 3. Each lower impeller 61 has a center piece or hub 67 with a bore 69 extending axially therethrough. Bore 69 slides over shaft 33. A notch 70 formed in bore 69 matingly engages a protrusion (not shown) on the outer surface of shaft 33 to connect lower impellers 61 to shaft 33 so that rotation of shaft 33 causes impellers 61 to rotate. A plurality of impeller vanes 71 connect to and extend radially outward from the outer circumference of hub 67. Impeller vanes 71 preferably extend along an axial portion of the outer surface of hub 67 between the top, downstream side of impeller shown in FIG. 3, and the lower, upstream side of impeller 71.

As shown in FIG. 4, each impeller vane 71 is curved along an angle of curvature θ between the axially upper and axially lower ends of vane 71. Referring back to FIG. 3, a direction of rotation is indicated with an arrow that defines a leading edge 73 and a trailing edge 75 of each vane 71. With reference to FIGS. 3 and 4, leading edge 73 is located along the axially lowermost portion of vane 71, and trailing edge 75 is located along the axially uppermost portion of vane 71. Leading and trailing edges 73, 75 can be straight or curved. An angle of curvature θ defines a concave surface 81 and convex surface between leading and trailing edges 73, 75 of vanes 71. The direction of rotation defines concave surface 81 as a leading or pressure surface that engages and acts upon well fluid 15 passing through impeller 61. The direction of rotation defines convex surface 83 as a trailing or suction surface that draws more well fluid 15 into the space between impeller vanes 71 to be acted upon by concave surface 81.

Referring back to FIG. 3, a radial line $L_1$ extends from the radial center point of impeller 61 to the outer end of leading edge 73, and a radial line $L_2$ extends from the radial center point to an inner end of leading edge 73 that connects to hub 67. Radial line $L_1$ leads radial line $L_2$ when impeller 61 rotates in the direction of rotation indicated by the arrow. Therefore, the outer end of leading edge 73 leads the inner end of leading edge 73. Leading edge 73 forces well fluid 15 radially inward by having the outer end of leading edge 73 lead the inner end of leading edge 73. This action acts against the centrifugal forces imparted on well fluid 15 by the rotation of impeller 61 creates turbulence in well fluid 15 and mixes or conditions well fluid 15 for entry into upper portion 35. Impellers 61 also increase the fluid velocity of well fluid 15 entering upper section 35, which reduces the amount of work that upper impellers 39 must exert on well fluid 15 to pump well fluid 15 to through conduit 13.

A radial line R extends from the center point of impeller 61 to the outer surface of hub 67. In the preferred embodiment, leading edge 73 forms a substantially straight line between outer and inner ends and is offset and substantially parallel to radial line R. Leading edge 73 is offset from radial line R by an offset distance $D_1$. In the preferred embodiment, trailing edge 75 is substantially parallel to leading edge 73 and radial line R, and is offset from radial line R by an offset distance $D_2$. As desired, an operator can change the aggressiveness or conditioning performance of impeller 71 by increasing or decreasing distances $D_1$ and $D_2$ while keeping leading and trailing edges 73, 75 substantially parallel to radial line R. Distances $D_1$ and $D_2$ can be increased to the point that leading edge 75 is substantially tangential to hub 67. Each impeller vane 71 has a straight median line that is offset from the axis of the hub, and the straight median line is parallel to and located equidistant between leading and trailing edges 73, 75.

Figure 6:
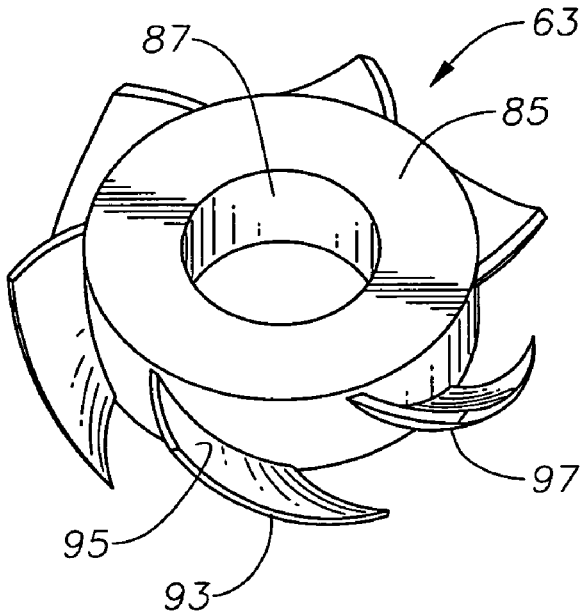
FIG. 6 is a perspective view the diffuser shown in FIG. 5 with the outer ring of the diffuser removed therefrom.

Referring to FIGS. 5 and 6, lower diffuser 63 is shown from the top, or downstream, side that is opposite the side of that receives well fluid 15 from lower diffuser 63. Lower diffuser 63 includes a hub 85 having a bore 87 that slides over and sliding engages shaft 33 (FIG. 2) when shaft 33 rotates. Bore 87 does not connect to shaft 33 so that diffuser 63 slidingly engages shaft 33 while remaining stationary relative to lower impeller 61. An outer ring 91 (not shown in FIG. 6) defines an outer circumference of lower diffuser 63. The inner surface of outer ring is a predetermined distance away from the outer surface of diffuser hub 85. A clearance 98 (FIG. 7) is located between the outer edge of each impeller vane 61 and the inner surface of outer ring 91, which also allows diffuser 63 to remain stationary relative rotating impellers 61.

As best shown in FIG. 2, diffuser outer rings 91 extend radially downward below hub 85 and enclose each lower impeller 61 associated with each particular stage 65. The lower end of each outer ring 91 engages the upper end of diffuser outer ring 91 in each preceding stage 65. In a manner known in the art, outer ring 91 of the lowermost diffuser 63 (not shown) lands on and engages an inner portion of pump housing 29 (not shown) so that diffusers 63 remain stationary while shaft 33 rotates impellers 61.

Referring back to FIGS. 5 and 6, a plurality of diffuser blades 93 extend between the outer surface of hub 85 and outer ring 91. Diffuser blades 93 stationarily connect outer ring 91 to diffuser hub 85. Each diffuser blade comprises a portion that is curved in more than one plane. A concave side 95 and a convex side 97 of blades 93 are defined by a curvature of each diffuser blade 93.

Figure 7:
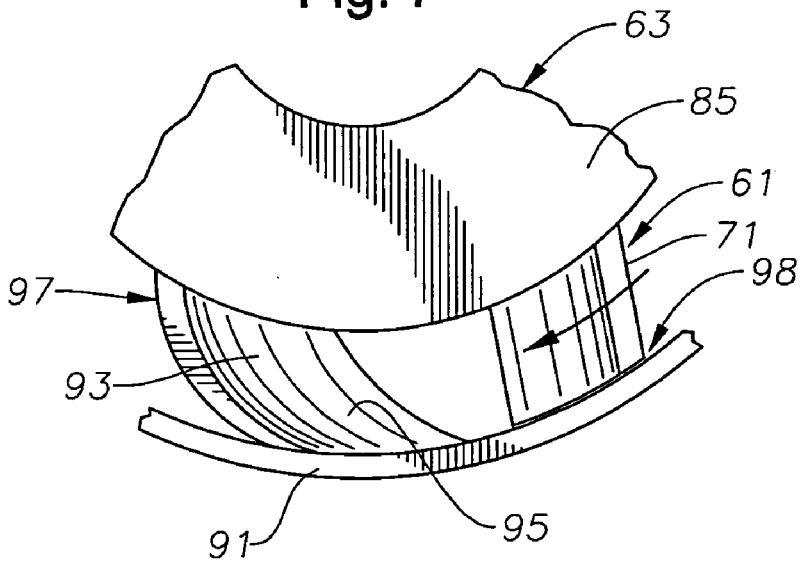
FIG. 7 is a partial perspective view of the impeller of FIG. 3 located below and rotating relative to the diffuser of FIG. 5.

As best shown in FIG. 7, due to the direction of rotation and placement of impeller 61 adjacent diffuser 63, concave side 95 receives well fluid 15 entering diffuser 63 from lower impeller 61, thereby defining an upstream side of diffuser blade 93. Convex side 97 is conversely defined as the downstream side of diffuser blade 91. Concave side 95 engages and redirects well fluid 15 entering diffuser 63 from lower impellers 61. In the preferred embodiment the outer end of each diffuser blade 93 leads the inner end. Additionally, as best shown in FIG. 6, diffuser blades 93 are axially inclined so that the axially lower portion of blade 93 is the leading or upstream edge. Therefore, the angle of incline from the upper portion of blades 93 to the lower, leading portion of blades 93 is rearward relative to the direction of rotation of impeller 61. Blades 93 are preferably portions or segments of a sphere. Accordingly, blades 93 have a scoop-shaped profile that further mixes the liquid and gas particles in well fluid 15 while redirecting well fluid 15 to the next stage 65 or to upper section 35.

In operation, pump assembly 11 is suspended from production tubing 17 within conduit 13. Power cable 27 conveys electrical power to motor 25 which then drives shaft 33. Rotation of shaft 33 causes upper and lower impellers 39, 61 to rotate within pump housing 29. The trailing edges, or suction sides of each impeller 39, 61 creates a slight pressure drop within pump housing 19 that draws well fluid 15 into pump 19 through pump inlet 20. Well fluid 15 entering pump 19 typically comprises gas-saturated liquid hydrocarbons. Well fluid 15 enters lower section 37. Within each conditioning stage 65 of impellers and diffusers 61, 63 in lower section 37, impellers 61 mix well fluid 15, while increasing the fluid velocity of well fluid 15, by forcing well fluid radially inward. Due to the outer end of each vane 71 leading the corresponding inner end, well fluid 15 is pushed radially inward, against the centrifugal forces imparted on well fluid 15 through the rotation of impellers 61. This helps to decrease the tendency of the gases saturated or entrained in well fluid 15 to separate from the liquids and form pockets of gas within pump 19.

Well fluid 15 exiting the axially upward, trailing edge 73 of vanes 71, enters lower diffusers 63. Well fluid 15 first engages the radial outward end of concave side 95 of each diffuser blade 93. The semispherical, or scoop profile of blade 93 guides well fluid 15 radially inward and axially upward through stationary diffusers 63. Well fluid 15 exits the upper portion of each lower diffuser 63 through the stack or series of impeller 61 and diffuser 63 stages 65 in lower section 37 until exiting the uppermost diffuser 63 into volute passage 53 between upper and lower sections 35, 37. Well fluid 15 entering upper section 35 is mixed and conditioned to reduce the likelihood of separation of gas particles in well fluid 15. This allows upper portion 35 to pump well fluid 15 with a larger gas content than usually permitted before "gas lock", with conventional upper impellers and diffusers 93, 41, up conduit 13 to the surface.

Figure 8:
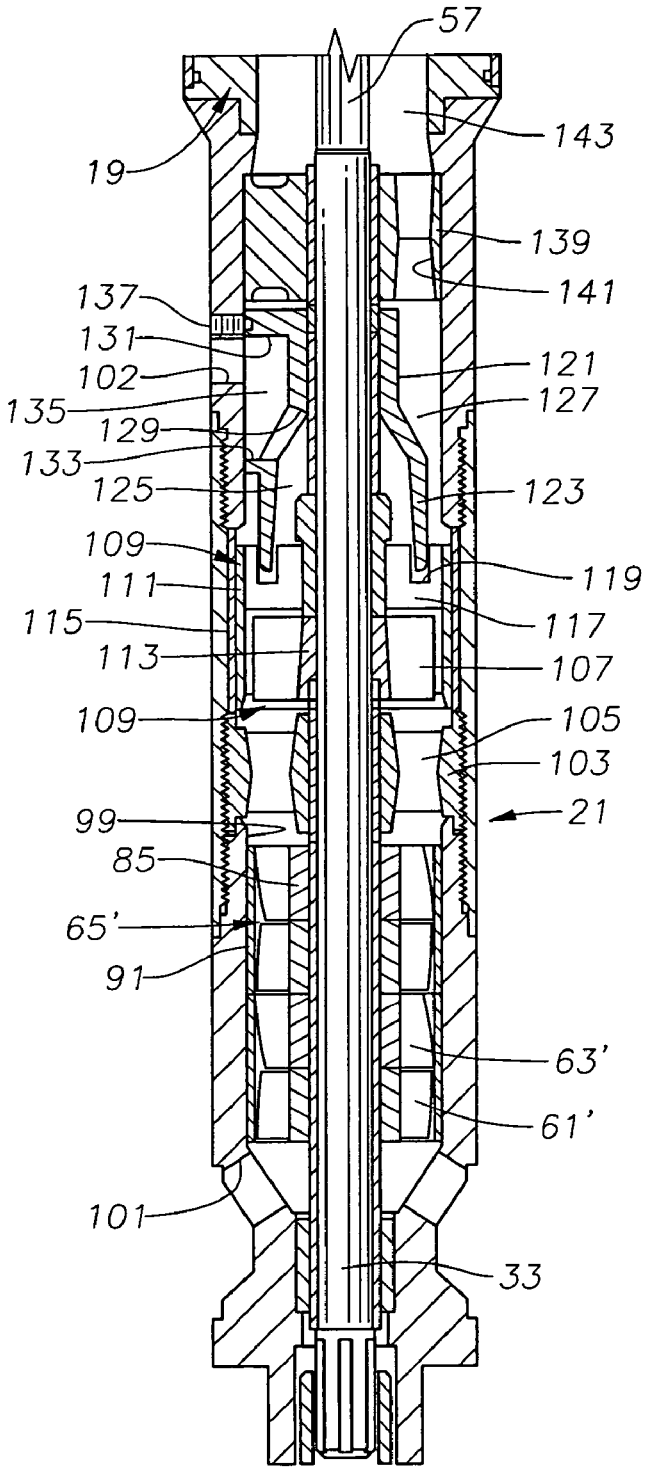
FIG. 8 is a sectional view of an alternative embodiment of a centrifugal separator having the impeller shown in FIG. 3 and the diffuser shown in FIG. 5.
Figure 9:
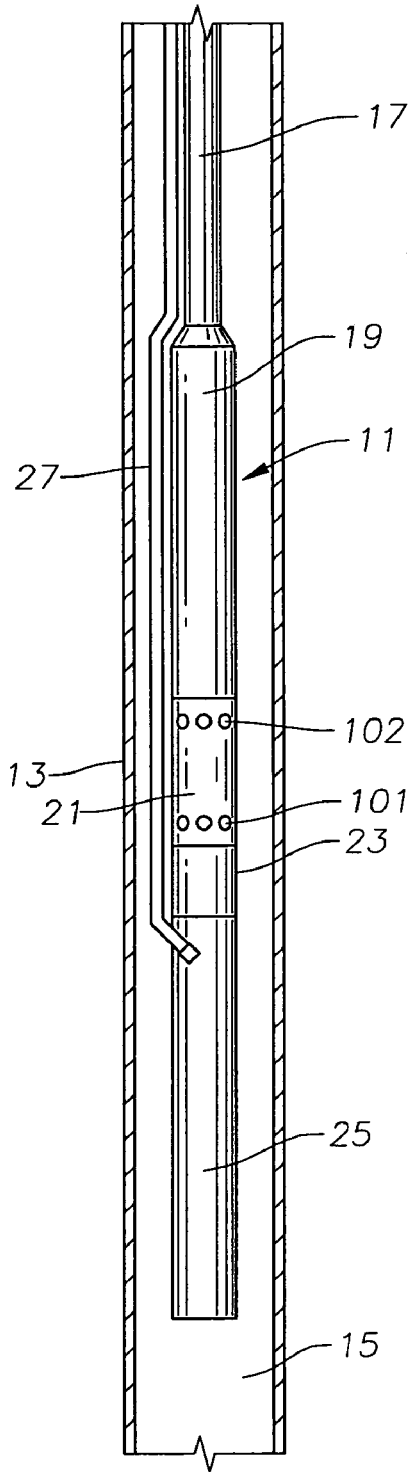
FIG. 9 is a side elevation view of the alternative centrifugal pump assembly shown in FIG. 8 that is constructed in accordance with this invention and is disposed in a viscous fluid within a well conduit.

Referring to FIGS. 8 and 9, an alternative embodiment of pump assembly 11 is also useful for well fluid 15 having a gas content that is up to about 40%. As shown in FIG. 9, pump assembly 11 includes a centrifugal gas separator 21 between seal section 23 and centrifugal pump 19. Rotating gas separator 21 has a well fluid inlet or lower intake 101 and an upper gas outlet 102 located below pump 19.

As shown in FIG. 8, gas separator 21 comprises a section of conditioning stages 65' having impellers 61' and diffusers 63'. Impellers 61' and diffusers 63' in the stack of conditioning stages 65' act upon well fluid 15 in substantially the same manner as impellers 61 and diffusers 63 in FIGS. 1-7. The well fluid 15 proceeds first to stages 65' which mixes and conveys well fluid 15 upward and pressurizes the well fluid 15 to prevent expansion of most of the gas contained in the well fluid 15. It may be is desirous to separate some of the gas in well fluid 15 before conveying well fluid 15 to pump 19 using the embodiment shown in FIGS. 8 and 9.

Upon exiting the uppermost diffuser 63' of the stack of stages 65', well fluid 15 passes through a bearing 103, typically a spider type, having a plurality of passages 105. Well fluid 15 proceeds to a set of guide vanes 107 that are mounted to shaft 33 for rotation therewith. Preferably, there are a plurality of guide vanes 107, each of which comprising a flat or curved plate, and each being inclined relative to the axis of shaft 33. Guide vanes 107 further impart a swirling motion to well fluid 15. Guide vanes 107 are located in a lower portion of a rotor 127. Rotor 127 has an outer cylinder 111 which extends down over guide vanes 107. Outer cylinder 111 encloses an inner hub 113 and is closely spaced within a stationary sleeve 115 mounted in passage 31. Inner hub 113 mounts to shaft 33 for rotation with shaft 33. Two or more rotor vanes 117 (only two shown) extend between hub 113 and outer cylinder 111. Vanes 117 comprise longitudinal blades extending from the lower end to the upper end of rotor 127. Each vane 117 is located in a radial plane of the axis of shaft 33. Each vane 117 is vertically oriented.

Each vane 117 preferably has a notch 119 formed in its upper end. Notch 119 is a longitudinal slot that extends downward from the upper edge of each vane 117. In the embodiment shown, each notch 119 is located approximately midway between hub 113 and outer cylinder 111. Notches 119 can be positioned to one side or the other of the midpoint between hub 113 and outer cylinder 111, depending on the amount of separation desired. Rotor 127 imparts a centrifugal force to well fluid 15 causing heavier liquid and some of the more saturated gases to flow outward toward outer cylinder 111 as well fluid 15 progresses up rotor 127. The lightest gases remain in the central portion of the rotor 127, near hub 113.

A discharge member 121 mounts stationarily directly above rotor 127. Discharge member 121 does not rotate with shaft 33. Discharge member has a depending skirt 123 that extends downward. Skirt 123 is concentric with shaft 33. Skirt 123 is annular, having an outer diameter significantly smaller than the inner diameter of passage 31 of housing 29. Inner diameter of skirt 123 is significantly greater than the outer diameter of inner hub 113. This results in an annular gas cavity 125 located within skirt 123. The clearance between skirt 123 and passage 31 comprises a liquid passage 127. Well fluid 15 that does not enter gas cavity 125 will flow up through liquid passage 127. A plurality of gas passages 129 (only one shown) extend through discharge member 121. In the embodiment shown, there are three of gas passages 129, and each communicates with gas outlet 102 extending through housing 29. Gas outlets 102 allow separated gas to be discharged into conduit 13.

Discharge member 121 has a plurality of laterally extending supports 131 (only one shown). In the embodiment shown, there are three supports 131 spaced 120 degrees apart from each other. Supports 131 extend out into contact with passage 31. Each support 131 has a generally rectangular perimeter, having flat upper and lower edges and side edges. The outer face of each support 131 is a segment of a cylinder having approximately the same diameter as the inner diameter of passage 31. The outer face of each support 131 extends circumferentially about 45 degrees.

Fluid 15 in liquid passage 127 flows between supports 131. A window 133, which is rectangular in the embodiment shown, is located in the outer face of each support 131. Window 133 registers with one of gas outlets 102 and communicates with a cavity 135 defined by the interior of each support 131. Window 133 and cavity 135 may be considered a part of gas passage 129 leading to gas outlet 102. A fastener, screw 137, or locking device extends through a hole in housing 29. The tip of screw 137 engages a dimple provided in one of the upper supports 131. This engagement prevents rotation of the discharge member 121 and also fixes discharge member 121 axially. A bearing 139 mounts in housing 29 above discharge member 121 for supporting shaft 33. Bearing 139 has one or more axial passages 141 for the flow of fluid. The fluid flows through a bore outlet 143 on the upper end into impeller inlets 45 (not shown in FIG. 8) of pump 19.

In operation, well fluid 15 having a high gas content flows in intake 101. Impellers 61' and diffusers 63' mix or condition well fluid 15 by forcing well fluid radially 15 inward against the centrifugal forces generated by rotating impellers 61'. Excess, less saturated gases in well fluid 15 separate from the heavier liquids and saturated gas while well fluid 15 passes through passages 105 and guide vanes 107. Excess gases flow near inner hub 113 and through gas cavity 125, gas passage 129, and exit gas outlet 102 into conduit 13. The remaining portion of well fluid 15, which is typically be a mixture of liquid and remaining entrained gases, flow up liquid passage 127 and through bearing passage 141 into bore outlet 143 into communication with impeller inlets 45 of pump 19.

The invention has significant advantages. By operating a submersible pump in the conduit, the amount of production can be significantly increased. Initially, many wells have adequate pressure to force the fluids up the riser without any assistance. However, as the well pressure drops over time, there is a need to artificially increase the pressure to aid oil production. In addition, as the production fluids flow up the well, the pressure drops and gases that were in solution become free gases. This invention is able to artificially boost the fluid pressure to increase production and force some of the free gases back into solution.

While the invention has been shown or described in only some of its forms, it should be apparent to those skilled in the art that it is not so limited, but is susceptible to various changes without departing from the scope of the invention.

The invention claimed is:

1. A well pump assembly for pumping a well fluid having a mixed flow of liquid and gas, comprising:

a conditioning impeller having a hub with a bore for engaging a shaft for rotating the conditioning impeller with the shaft in a forward rotation direction;

a stationary conditioning diffuser juxtaposed with the conditioning impeller to receive the well fluid from the impeller, the diffuser having a plurality of blades that incline from a downstream side to an upstream side of the diffuser in a rearward rotational direction; and a plurality of impeller vanes extending from the outer circumference of the hub of the conditioning impeller, each of the vanes inclining in the forward rotational direction from a downstream side of the impeller, defining a leading edge and a trailing edge, and wherein a radial line passing through an outer end of the leading edge of each of the vanes is rotationally forward of an inner end of the leading edge of each of the vanes for forcing liquid and gas radially inward and into the diffuser.

2. The well pump assembly of claim 1, wherein the leading and trailing edges of each of the impeller vanes are straight and substantially parallel to each other.

3. The well pump assembly of claim 1, wherein each impeller vane is curved from the leading edge to the trailing edge.

4. The well pump assembly of claim 1, wherein the leading and trailing edges of each impeller vane are substantially parallel to and are offset from a radial line of the impeller that is located rotationally forward of the vane.

5. The well pump assembly of claim 1, wherein each diffuser blade is curved from the upstream side to the downstream side.

6. The well pump assembly of claim 1, wherein each diffuser blade comprises a portion that is curved in more than one ef plane.

7. The well pump assembly of claim 1, wherein each impeller vane has a straight median line that is offset from the axis of the hub.

8. The well pump assembly of claim 1, further comprising:

a plurality of pumping impellers located downstream of the conditioning impeller for receiving the well fluid from the conditioning impeller and increasing the well fluid pressure, the pumping impellers having a plurality of curved passages; and a pumping diffuser located between each pumping impeller and having a plurality of curved passages.

9. The well pump assembly of claim 1, further comprising a gas separator located downstream of the conditioning impeller, the separator having a rotating blade for forcing liquid in the well fluid outward relative to gas in the well fluid within a central bore.

10. A well pump assembly for pumping a well fluid having a mixed flow of liquid and gas, comprising:

an outer casing with an axial centerline;

a shaft extending through a portion of the outer casing along the axial centerline of the casing;

a conditioning impeller having a hub with a bore engaging the shaft for rotating the conditioning impeller with the shaft;

a conditioning diffuser stationarily mounted in the outer casing to receive the well fluid from the impeller, the diffuser having a plurality of blades that curve in an outward direction from an upstream side to a downstream side; and a plurality of impeller vanes extending from the hub the impeller, each of the vanes having a straight edge that is substantially parallel to and offset from a radial line of the impeller.

11. The well pump assembly of claim 10, wherein each impeller vane includes a leading edge and a trailing edge and is curved from the leading edge to the trailing edge.

12. The well pump assembly of claim 10, wherein the straight edge defines a leading edge having an outer end that is upstream of an inner end of the leading edge.

13. The well pump assembly of claim 10, wherein each diffuser blade is curved in an axial direction from the upstream side to the downstream side.

14. The well pump assembly of claim 10, wherein each diffuser blade comprises a portion that is curved in more than one plane.

15. The well pump assembly of claim 10, further comprising:

a plurality of pumping impellers located downstream of the conditioning impeller for receiving the well fluid from the conditioning impeller and increasing the well fluid pressure, the pumping impellers having a plurality of curved passages; and a pumping diffuser located between each pumping impeller and having a plurality of curved passages.

16. The well pump assembly of claim 10, further comprising a gas separator located downstream of the conditioning impeller, the separator having a rotating blade for forcing liquid in the well fluid outward relative to gas in the well fluid within a central bore.

17. A well pump assembly for pumping a gaseous well fluid having a mixed flow of liquid and gas, comprising:

an outer casing with an axial centerline;

a shaft extending through a portion of the outer casing along the axial centerline of the casing;

a conditioning section for mixing the gaseous well fluid entering the well pump assembly comprising: a conditioning impeller having a hub with a bore for engaging a shaft for rotating the conditioning impeller with the shaft in a forward rotation direction, a stationary conditioning diffuser juxtaposed with the conditioning impeller to receive fluid from the impeller, the diffuser having a plurality of blades that incline from a downstream side to an upstream side of the diffuser in a rearward rotational direction, and a plurality of impeller vanes extending from the outer circumference of the hub of the conditioning impeller, each of the vanes inclining in the forward rotational direction from a downstream side of the impeller, defining a leading edge and a trailing edge, and wherein a radial line passing through an outer end of the leading edge of each of the vanes is rotationally forward of an inner end of the leading edge of each of the vanes for forcing liquid and gas radially inward and into the diffuser; and a pump section for pumping the gaseous well fluid from the well, comprising: a plurality of pump impellers and pump diffusers.

18. The well pump assembly of claim 17, wherein each impeller vane is curved from the leading edge to the trailing edge.

19. The well pump assembly of claim 17, wherein the leading and trailing edges of each impeller vane are substantially parallel to and are offset from a radial line of the impeller that is located rotationally forward of the vane.

20. The well pump assembly of claim 17, wherein each diffuser blade is curved from the upstream side to the downstream side.

21. A method for pumping a well fluid with mixed flow of liquid and gas, comprising:

rotating a conditioning impeller having a hub with a bore for engaging a shaft for rotating the conditioning impeller with the shaft in a forward rotation direction;

creating turbulence by forcing the well fluid radially inward against centrifugal forces with a plurality of impeller vanes extending from the outer circumference of the hub of the conditioning impeller that have an outer end of a leading edge of each of the vanes that is rotationally forward of an inner end of the leading edge of each of the vanes; and continuing to force the well fluid radially inward with a stationary conditioning diffuser receiving well fluid from the impeller and having a plurality of blades that incline from an upstream side to a downstream side of the diffuser in a rearward rotational direction.

22. The method of claim 21, further comprising conveying the well fluid to a set of pumping impellers for pumping the well fluid up a conduit.

* * * * *

UNITED STATES PATENT AND TRADEMARK OFFICE

CERTIFICATE OF CORRECTION

PATENT NO. : 7,241,104 B2
APPLICATION NO. : 10/784340
DATED : July 10, 2007
INVENTOR(S) : Brown Lyle Wilson et al.

It is certified that error appears in the above-identified patent and that said Letters Patent is hereby corrected as shown below:

On The Title Page (57)
In the Abstract:

line 13, delete "concaved" and insert --concave--

In the Specification:

Column 3, line 31, delete "is be" before "driven"
Column 3, line 32, insert --is-- before "mounted"
Column 5, line 65, delete "sliding" and insert --slidingly-- before "engages"

Signed and Sealed this

Twentieth Day of November, 2007

JON W. DUDAS
*Director of the United States Patent and Trademark Office*